United States Patent [19]

Prins

[11] Patent Number: 4,740,130

[45] Date of Patent: Apr. 26, 1988

[54] HOPPER

[75] Inventor: Petrus D. Prins, Roodepoort, South Africa

[73] Assignee: Peter Redvers Thorburn, South Africa

[21] Appl. No.: 929,406

[22] Filed: Nov. 10, 1986

[30] Foreign Application Priority Data

Nov. 12, 1985 [ZA] South Africa ..... 85/8657

[51] Int. Cl.[4] ..... B61D 7/30

[52] U.S. Cl. ..... 414/378; 414/387; 105/241.2; 105/250

[58] Field of Search ..... 414/377, 378, 383, 387, 414/388, 495, 572, 376, 385; 105/239, 250, 241.1, 241.2

[56] References Cited

U.S. PATENT DOCUMENTS

| | | | |
|---|---|---|---|
| 3,529,734 | 9/1970 | Marais | 105/241.1 |
| 4,339,222 | 7/1982 | Knippel | 414/387 |

FOREIGN PATENT DOCUMENTS

| | | | |
|---|---|---|---|
| 471316 | 2/1929 | Fed. Rep. of Germany | 414/378 |
| 84/7046 | 3/1985 | South Africa . | |
| 598320 | 2/1948 | United Kingdom | 414/388 |

*Primary Examiner*—Leslie J. Paperner
*Assistant Examiner*—Vien Nguyen
*Attorney, Agent, or Firm*—McGlew and Tuttle

[57] ABSTRACT

A bottom discharge hopper the body of which is elevated at a tip by ramps so that doors on the underside of the body, which are secured thereto by links and which are pivotally fixed to upstanding structure on the chassis, open outwardly and downwardly to permit material discharge from the body.

8 Claims, 4 Drawing Sheets

HOPPER

BACKGROUND OF THE INVENTION

This invention relates to a hopper.

South African Pat. No. 84/7046 describes a bottom discharge hopper which has two doors directly pivotally fixed to the body of the hopper, and pivotally connected by means of links to support structure at an end of the hopper. As the body is raised relative to its chassis the doors pivot downwardly with the door movement being controlled inter alia by the links. It has been found in practice that substantial stresses are generated in the links as the doors are opened for, while extending laterally, they are required to support significant loadings, and that the door movement is not controlled as smoothly as described.

SUMMARY OF THE INVENTION

According to the invention a hopper includes a wheeled chassis, a body which is mounted on the chassis, the body including side and end walls, a filling opening at an upper end of the body, and a discharge opening located at the bottom of the body, a member at least at one end of the chassis which extends upwardly from the chassis adjacent a respective end wall of the body, at least one door which is pivotally fixed to the body by means of a link which extends between a pivot connection on the body, and a pivot connection at a first point on the door, anchor means which secures the door to the member at a second point and which permits movement of the door relative to the member, and means mounted on the body which cooperates with means located at a discharge tip thereby to raise the body relative to the chassis from a first position at which the door closes the discharge opening, to a second position at which the door is away from the discharge opening thereby to permit discharge of material from the body through the discharge opening.

The anchor means may comprise a pivotal connection of the door to the member at the second point.

With the body at the first position the first point may be lower than the second point. On the other hand when the body is at the second position the first point may be higher than the second point.

In a variation of the invention the anchor means includes first and second pivot connections between the door and the member, the arrangement being such that as the door opens it pivots firstly about the first pivot connection and then about the second pivot connection. On door closure the sequence is reversed.

The door may include a vertically extending flange adjacent the respective end wall of the body, the anchor means being secured to the flange, and to the member at the second point.

Preferably the first point is on or adjacent a respective side wall of the body. Normal use would be made of two doors so that, with this particular version of the invention, the hopper is of the bottom discharge type and, with the doors opening outwardly and downwardly from the discharge opening, the hopper may also be described as being of a central discharge type.

It is of course possible to pivot the doors to the body substantially at a centreline thereof in which event the hopper is still of the bottom discharge type but discharge will take place in two streams of material on either side of the centreline respectively.

It has been found that certain types of material, when subjected to vibration which arises from the hopper moving along tracks or the like, tend to compact within the body and make complete discharge of the material from the body difficult to achieve. This problem is countered, according to one feature of the invention, by forming the discharge opening larger, in cross-sectional area, than the filling opening. This may be implemented by inclining the side walls, and preferably the end walls as well, outwardly from the filling to the discharge opening.

BRIEF DESCRIPTION OF THE DRAWINGS

The invention is further described by way of examples with reference to the accompanying drawings in which.

DESCRIPTION OF PREFERRED EMBODIMENT

Figure 1:
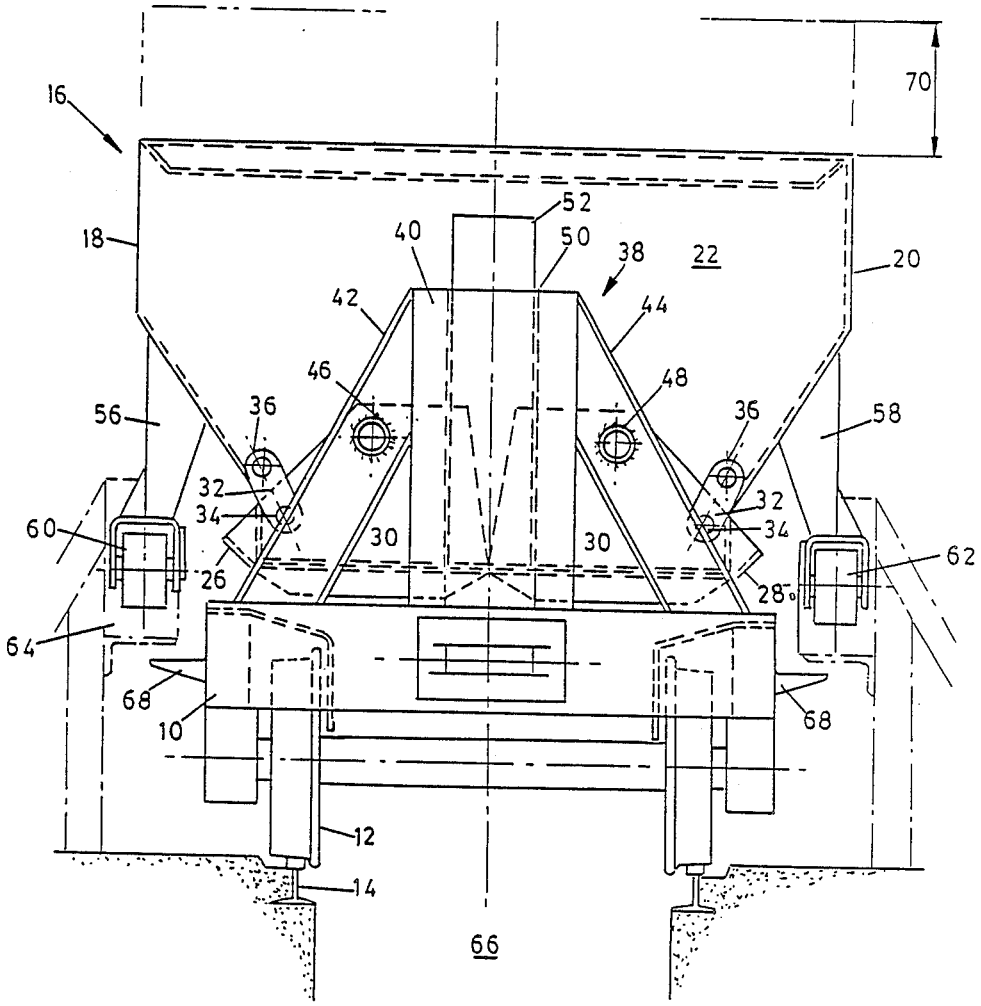
FIG. 1 is an end view of a hopper according to a first form of the invention in a transport mode.
Figure 2:
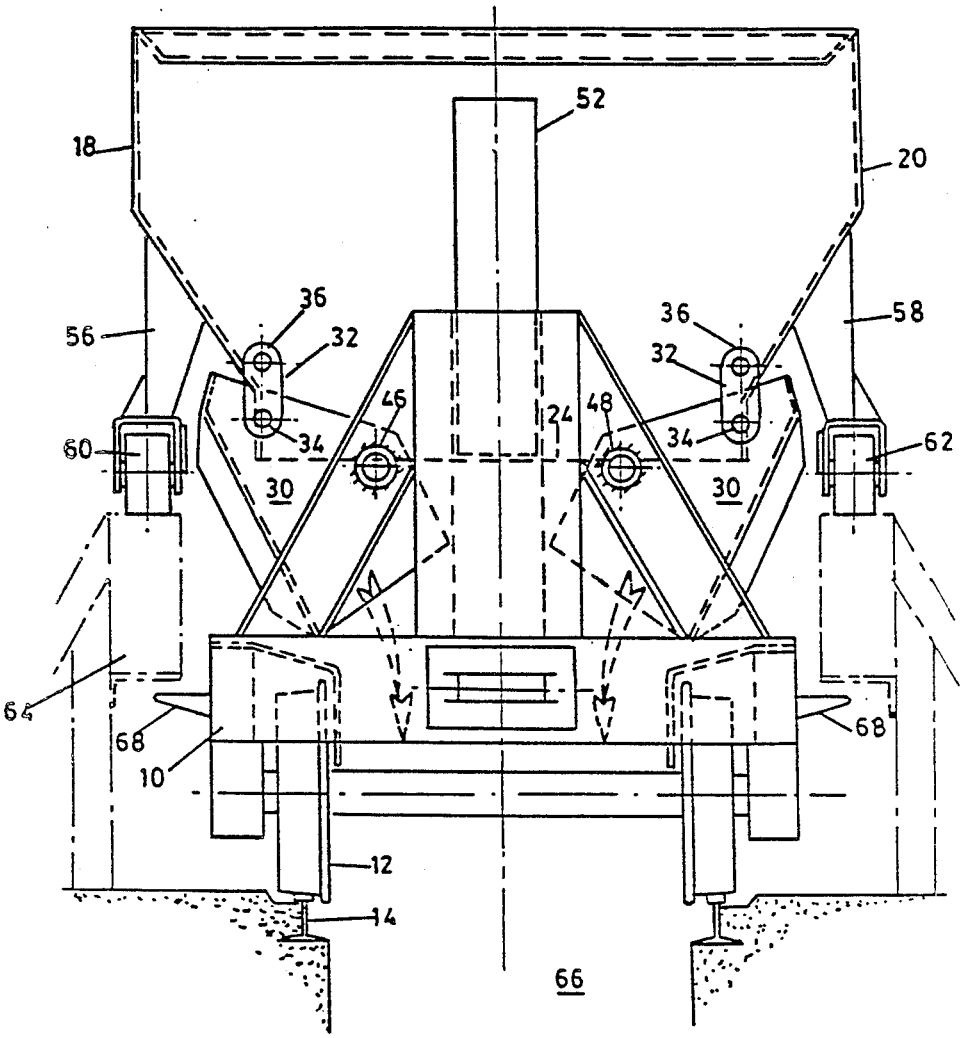
FIG. 2 shows the hopper of FIG. 1 in a discharge mode.

FIGS. 1 and 2 illustrate a hopper according to the invention which includes a chassis 10 which is mounted on wheels 12 which are adapted to run on rails 14, a body 16 which is mounted on the chassis 10, the body including side walls 18 and 20 respectively and end walls 22, a discharge opening 24 being located at the bottom of the body, two doors 26 and 28 which have vertically extending flanges 30 adjacent the respective end walls 22 of the body, links 32 which fix the doors to the body, each link being pivotally connected to a respective flange 30 at a pivot point 34, and to the body at a pivot point 36 which is adjacent a respective side wall 18 or 20 of the body, an upstanding member 38 which extends from the chassis adjacent each respective end wall 22 of the body, the member 38 including a central column 40 which is braced by means of struts 42 and 44 respectively, each flange 30 being directly pivotally secured to a respective strut at pivot points 46 and 48 respectively, the central column 40 including a vertically extending guide channel 50, the end walls 22 of the body including vertically extending guide formations 52 which are slidably engaged in the guide channels 50, and supports 56 and 58, on opposed sides of the body, which carry dolly wheels 60 and 62 respectively.

In the drawings the dolly wheels are shown engaging with ramp structure 64 positioned on opposing sides of a discharge tip opening 66. The ramp structure is substantially conventional in design and therefor is not elaborated on in the specification.

The hopper includes outwardly extending flanges 68, on opposed sides of the chassis, which extend below the ramps and which do not normally engage directly with the ramp when the hopper traverses the tip opening 66.

With the hopper of the invention in the closed position, i.e. the transport mode, shown in FIG. 1, the links 32 depend downwardly from the body. The doors are essentially suspended from the pivot points 46 and 48 and, due to the geometry, cannot open of their own accord for this type of movement requires a corresponding upward movement of the body relatively to the chassis.

As the hopper moves along the rails 14 the dolly wheels 60 and 62 are brought into engagement with the opposed ramps 64 on either side of the tip opening. The body is thereby raised relatively to the chassis by an amount 70 which is indicated in FIG. 1. As the body rises the doors are rotated about the pivot points 46 and 48 respectively, which are anchored to the chassis, by means of upwardly directed forces which are applied to the respective links 32 and 34 by the upwardly moving body, and by means of downwardly directed loading exerted on the doors by the material inside the body. The doors thus take on the orientation shown in FIG. 2 at which the discharge opening 24 is fully opened and so permits material to be discharged from the body 16 into the tip 66.

The movement of the doors relatively to the body is determined inter alia by the dimensions of the links 32, and by the positions of the pivot points 34, 36, 46 and 48 respectively. It is to be observed that, referring to FIG. 1, when the hopper is in the transport mode, the pivot points 36 are below the pivot points 46 and 48 respectively. On the other hand when the body is raised to place the hopper in the discharge mode shown in FIG. 2 the pivot points 36 are higher than the pivot points 46 and 48. This feature is closely related to the relative positions of the moving parts and pivot points and to the fact that the vertical movement 70 of the body is relatively small in order to achieve maximum door opening movement.

When the body starts rising above the chassis the material which is located in the body acts on the inner surfaces of the doors thereby providing assistance to the leverage which is required to elevate the body. The positioning of the links and the pivot points is such that a smooth opening action of the door takes place.

The flanges 68 which extend under the ramps ensure that, for whatever reason, the hopper cannot be derailed while it is engaged with the ramps and while it is traversing the tip.

It is to be noted from FIG. 2 that the undersides of the fully opened doors are steeper than the angled position of the side walls. This ensures a good cleaning action of the doors.

As the hopper leaves the tip the body 16 settles down on the chassis at a rate which is controlled by the profile of the ramp and the doors pivot upwardly and inwardly to seal off the discharge opening.

The links 32 depend substantially downwardly during all phases of movement of the doors. Thus the problem of loading laterally disposed links encountered with the hopper of South African Pat. No. 84/7046 is obviated for the pivots 46 and 48 are able to carry the loading and simultaneous pivotal door movement with ease.

Figure 3:
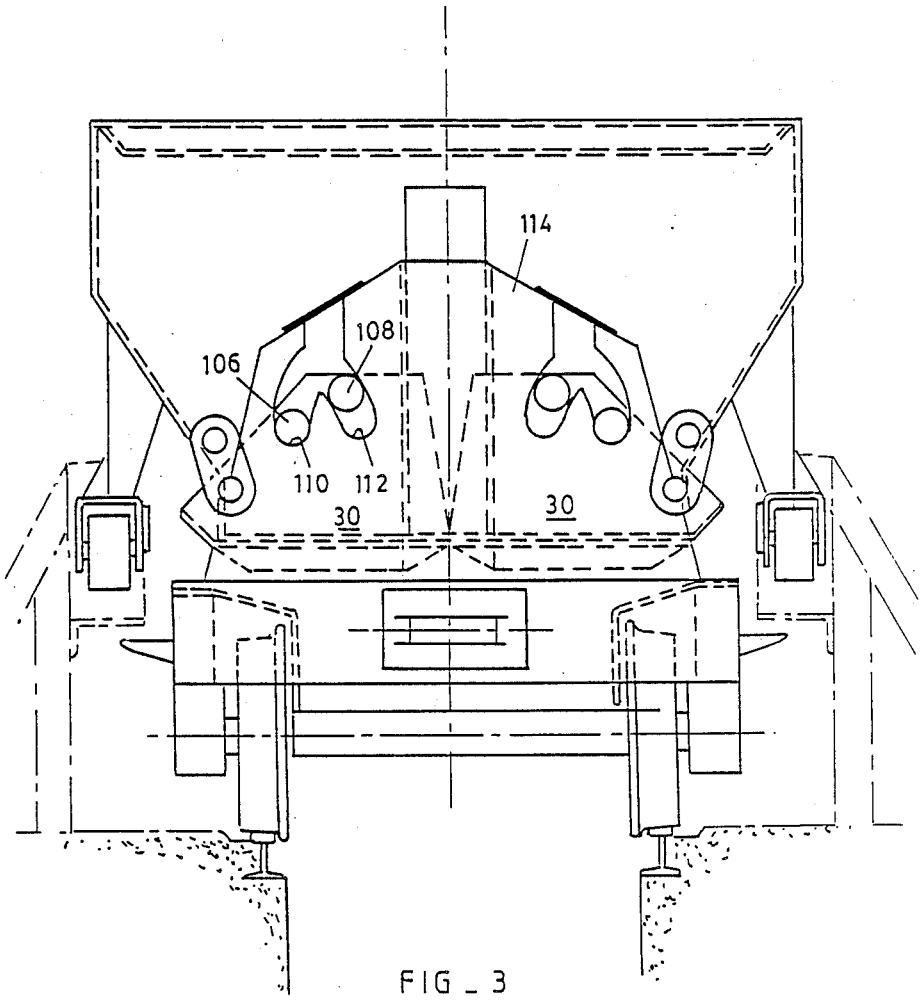
FIG. 3 is an end view of a hopper according to a second form of the invention in a transport mode.

FIG. 3 shows a hopper, similar to that of FIGS. 1 and 2, but with the pivot points 46 and 48 each replaced by two pins or rollers 106 and 108 respectively, which are fixed to the flanges 30, and which respectively engage in recessed slots 110 and 112 on an end plate 114 respectively. In this arrangement, as the body rises, door rotation initially takes place about the roller 106 in the slot 110. With this action the roller 108 descends, and settles into the slot 112. As the body continues to rise each door rotates about its roller 108 which pivots in the corresponding slot 112, and the roller 106 lifts clear of the slot 110. The reverse sequence of events takes place as the body descends.

The two stage action results in a particularly smooth door opening movement without the components being unduly stressed. The slots 110 and 112 could in practice collect dirt. This problem can be reduced by locating profiled members, similar in outline to the slots, but inverted, on the flanges 30, and by fixing rollers to the end plate 114.

In both versions of the hopper the guide formation 52 moves in the guide channel 50 as the body is raised or lowered. This is an important feature for it imparts stability to the body particularly when high forces are applied to the body which could conceivably cause the body to be tipped over. The formation 52 could for example be replaced by a roller, or include a low friction pad, which ensures easy relative movement of the components.

Figure 4:
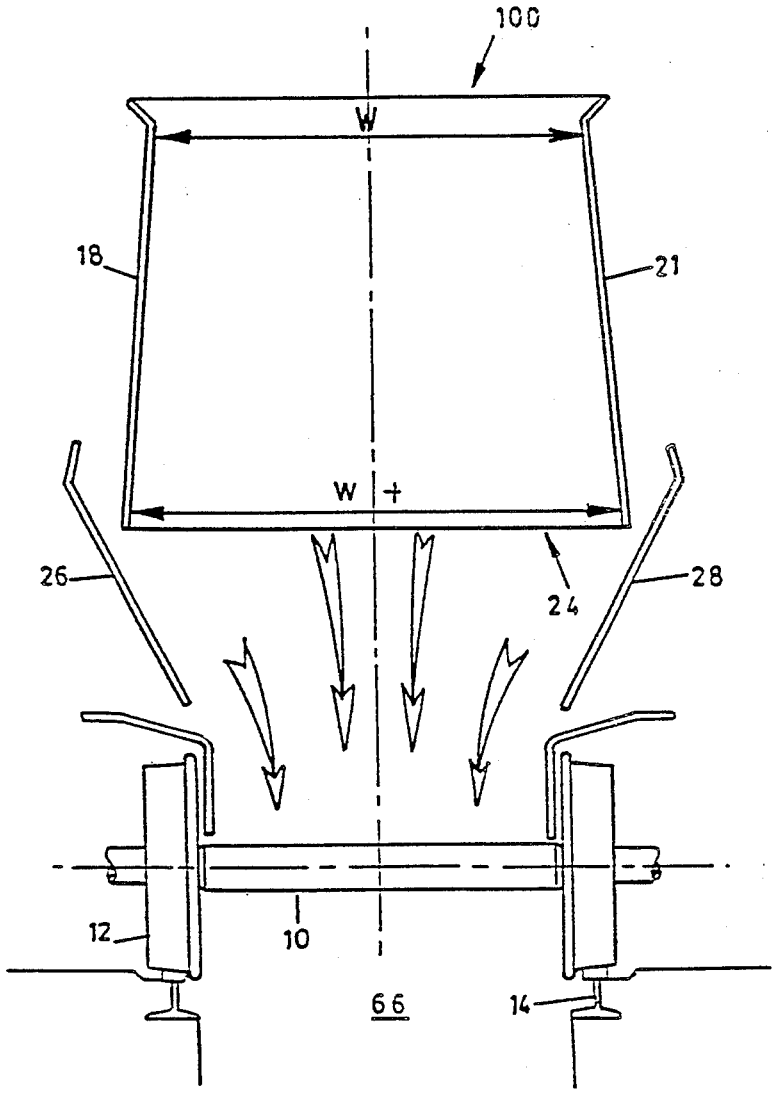
FIG. 4 illustrates a feature which can be included in either of the hoppers.

As previously indicated, when certain types of material, such as wet, fine ores, are carried in a hopper, there is a tendency for the material to compact in the body, during hopper movement, and this prevents rapid and easy discharge of such material from the hopper. FIG. 4 illustrates schematically an arrangement wherein the side walls 18 and 20 of the hopper taper outwardly from top to bottom so that the mouth of the filling opening 100 has a width W which is less than the width W+ of the mouth of the discharge opening 24. More generally the cross-sectional area of the filling opening 100 is less than the cross-sectional area of the discharge opening 24. Material is therefor less likely to cling to the internal surfaces of the hopper walls which face sideways and downwards and the easy discharge of material from the hopper is promoted.

I claim:

1. A hopper comprising a wheeled chassis, a body which is mounted on the chassis, the body including side and end walls, a filling opening at an upper end of the body, and a discharge opening located at the bottom of the body, a member at least at one end of the chassis which extends upwardly from the chassis adjacent a respective end wall of the body, at least one door which is pivotally fixed to the body by means of a link which extends between a pivot connection on the body, and a pivot connection at a first point on the door, anchor means which comprises first and second pivot connections between the door and the member thereby securing the door to the member at a second point and which permits movement of the door relative to the member, and raising means mounted on the body which cooperates with ramp structure located at a discharge tip thereby to raise the body relative to the chassis from a first position at which the door closes the discharge opening, to a second position at which the door is away from the discharge opening thereby to permit discharge of material from the body through the discharge opening, the door as it opens pivoting first about the first pivot connection and then about the second pivot connection.

2. A hopper according to claim 1 wherein the anchor means comprises a pivotal connection of the door to the member at the second point.

3. A hopper comprising a wheeled chassis, a body which is mounted on the chassis, the body including side and end walls, a filling opening at an upper end of the body, and a discharge opening located at the bottom of the body, a member at least at one end of the chassis which extends upwardly from the chassis adjacent a respective end wall of the body, at least one door which is pivotally fixed to the body by means of a link which extends between a pivot connection on the body and a pivot connection at a first point on the door, anchor means which secures the door to the member at a second point and which permits movement of the door relative to the member, and raising means mounted on the body which cooperates with ramp structure located at a discharge tip thereby mo raise the body relative to the chassis from a first position at which the door closes the discharge opening, to a second position at which the door is away from the discharge opening thereby to permit discharge of material from the body through the discharge opening, the arrangement being such that when the body is at the first position, the first point is lower than the second point, and when the body is at the second position, the first point is higher than the second point.

4. A hopper according to claim 3 wherein the body, on the respective end wall, and the member, include interengaging formations which are vertically relatively movable and which guide the movement of the body relatively to the chassis as the body is moved between the first and second positions.

5. A hopper according to claim 3 wherein the door includes a vertically extending flange adjacent the respective end wall of the body, the anchor means being secured to the flange, and to the member at the second point.

6. A hopper according to claim 3 wherein the first pivot point is on or adjacent a respective side wall of the body.

7. A hopper according to claim 3 wherein the cross-sectional area of the filling opening is less than the cross-sectional area of the discharge opening.

8. A hopper according to claim 7 wherein at least the side walls taper outwardly from the filling to the discharge opening.

* * * * *